US006010320A

United States Patent [19]

Kwon

[11] Patent Number: 6,010,320

[45] Date of Patent: Jan. 4, 2000

[54] COMPRESSOR SYSTEM HAVING AN OIL SEPARATOR

[76] Inventor: Hee-sung Kwon, 1314-202 Mokdong-shinsigaji Apt., 327 Shinjeong-dong Yangcheon-gu, Seoul, Rep. of Korea

[21] Appl. No.: 08/903,304

[22] Filed: Jul. 30, 1997

[51] Int. Cl.[7] ..... F04C 29/02

[52] U.S. Cl. ..... 418/85; 418/89; 418/97; 418/DIG. 1; 184/6.16

[58] Field of Search ..... 418/85, 89, 97, 418/201.1, DIG. 1; 184/6.16, 6.21

[56] References Cited

U.S. PATENT DOCUMENTS

| | | | |
|---|---|---|---|
| Re. 27,691 | 7/1973 | Harlin et al. | 418/DIG. 1 |
| 3,776,668 | 12/1973 | Abendschein | 418/DIG. 1 |
| 4,295,806 | 10/1981 | Tanaka et al. | 418/DIG. 1 |
| 4,342,547 | 8/1982 | Yamada et al. | 418/DIG. 1 |
| 4,420,293 | 12/1983 | Hofmann | 418/85 |
| 4,913,634 | 4/1990 | Nagata et al. | 418/DIG. 1 |
| 5,246,357 | 9/1993 | Sjoholm et al. | 418/97 |

FOREIGN PATENT DOCUMENTS

| | | | |
|---|---|---|---|
| 59-32690 | 2/1984 | Japan | 418/DIG. 1 |
| 63-16190 | 1/1988 | Japan | 418/DIG. 1 |

*Primary Examiner*—John J. Vrablik
*Attorney, Agent, or Firm*—Leydig, Voit & Mayer, Ltd.

[57] ABSTRACT

In a compressor system, a compressor main unit compresses air taken in and exhausts the compressed air with oil. The compressed air and the oil exhausted from the compressor main unit are stored in a reservoir. A head tank has an internal space and is coupled to the compressed main unit and the reservoir. An oil separator which is installed in the head tank separates the oil exhausted from the head tank from the compressed air.

23 Claims, 8 Drawing Sheets

COMPRESSOR SYSTEM HAVING AN OIL SEPARATOR

Background of the Invention

The present invention relates to a compressor system, and more particularly, to a compressor system having an improved structure so that noise and vibrations are reduced and miniaturization is easily achieved.

A type of compressor which increases the pressure of a gas and exhausts the compressed gas is a rotor-type compressor. The rotor-type compressor has a pair of rotors, female and male which are respectively installed on two axes in parallel and rotate interlockingly. While rotating, the female and male rotors take in, compress and exhaust gas. In doing so, oil is supplied to reduce abrasion and heating occurring due to friction between the rotating female and male rotors.

FIG. 1 schematically shows a conventional rotor-type compressor system. Reference numeral 27 indicates a housing for accommodating elements of the compressor system in which a grilled air passage 28 is formed at one side surface. Reference numeral 3 indicates a compressor main unit in which a pair of rotors 3*a* for compressing air taken in through an air cleaner 4 are installed. The rotors 3*a* are rotated by a driving motor 1, and the air compressed by the rotor 3*a* is supplied to an accumulator 5 via an exhaust pipe 3*b*. The accumulator 5 is usually fabricated by molding or welding several metal plates. A cooling oil is supplied to the rotor 3*a* through a first oil supply pipe 21 to reduce abrasion and heating due to the pair of rotors 3*a* which rotate while interlocking with each other, and thermal expansion of the rotor 3*a* due to the heat.

An oil separator 7 is installed inside the accumulator 5 and separates oil 6*a* included in the compressed air which is supplied through the exhaust pipe 3*b*. That is, a portion of the oil which is splashed together with the compressed air to the accumulator 5 precipitates down and then is stored in the accumulator 5, and the remaining portion of the oil sticks to the oil separator 7. The oil stuck to the oil separator 7 is supplied to a bearing (not shown) installed on the axis of the rotor 3*a* via an auxiliary oil line 25.

The compressed air passed through the oil separator 7 is supplied to a desired location via a pressure valve 8, an air pipe 11, an air cooler 10 and a service pipe 12. The pressure valve 8 being operated by a pressure switch 17 opens when the pressure in the accumulator 5 is beyond a preset value.

The oil 6*a* which is exhausted from the accumulator 5 through a first oil transmission pipe 23 is selectively supplied by a temperature regulator 15 to the first oil supply pipe 21 and a second oil transmission pipe 24. That is, during the initial operation of the compressor, when the temperature of the oil 6*a* is relatively low, the oil is transferred through the first oil supply pipe 21 and supplied to the rotor 3*a*. When the temperature of the oil 6*a* is relatively high, the oil is supplied to the oil cooler 20 through the second oil transmission pipe 24. The oil supplied to the oil cooler 20 is cooled and then supplied to the temperature regulator 15 through a second oil supply pipe 22. The oil passes through an oil filter 16 and flows into the first oil supply pipe 21 by the operation of the temperature regulator 15.

The above conventional compressor system has the following problems.

First, since the compressor main unit 3, the temperature regulator 15 and the oil filter 16 are connected to the accumulator 5 by the exhaust pipe 3*b* and the first oil transmission pipe 23, the compressor system is complicated and the size is large. Thus, loss of pressure in the pipes increases, the system becomes susceptible to vibrations, and a great amount of oil is required.

Second, since the accumulator 5 is usually fabricated by molding or welding several metal plates, the production thereof is slow.

Third, since the output of the exhaust pipe 3*b* is installed at a place adjacent to the inlet of the oil separator 7, most of the oil included in the compressed air splashed to the accumulator 5 does not precipitate but passes through the oil separator together with the compressed air. Thus, the efficiency of oil separation is lowered and also the life span thereof is shortened.

SUMMARY OF THE INVENTION

To overcome the above problems, it is an objective of the present invention to provide a compressor system which has simplified structure and which is capable of being miniaturized.

It is another objective of the present invention to provide a compressor system in which the performance of an oil separator is improved.

Accordingly, to achieve the above objectives, there is provided a compressor system comprising: a compressor main unit for compressing air which is taken in and exhausting the compressed gas with oil; a reservoir in which the compressed air and the oil exhausted from the compressor main unit are stored; a head tank having an internal space and being interposed between and coupled to the compressed main unit and the reservoir so that the internal space of the head tank is opened to the compressor main unit and the reservoir; and an oil separator, installed in the head tank, for separating the oil exhausted from the head tank from the compressed air.

In the above compressor system, a first opening to which the compressor main unit is coupled is formed at one side of the head tank and a second opening to which the reservoir is coupled is formed at the other side thereof.

The compressor system further comprises an exhaust pipe, installed in the compressor main unit to extend via the head tank and to the inside of the reservoir, for guiding the compressed air and the oil exhausted from the compressor main unit, in which an outlet end portion of the exhaust pipe is bent upward.

Preferably, the outlet portion of the exhaust pipe is spiral and the end portion of the outlet portion is bent upward.

It is preferable in the present invention that the compressor main unit of a compressor system comprise a rotor casing having an intake chamber into which air is taken and female and male rotors interlockingly rotating is accommodated; and an exhaust casing coupled to the rotor casing and having an exhaust chamber into which the compressed air flows from the rotor casing, in which the exhaust pipe is installed in the exhaust casing.

Also, the compressor main unit of the compressor system further comprises a rotor flange which is installed between the rotor casing and the exhaust casing and is coupled to a flange formed around the first opening of the head tank.

According to another embodiment of the present invention, a compressor system is provided, in which the compressor main unit comprises: a rotor casing having an intake chamber into which air is taken and female and male rotors interlockingly rotating is accommodated; and an exhaust casing coupled to the rotor casing and having an exhaust chamber into which the compressed air flows from the rotor casing, in which the rotor casing is integrally formed with the head tank.

According to yet another embodiment of the present invention, a compressor system is provided in which a first opening coupled to the compressor main unit and a second opening coupled to the reservoir are separately formed at the same side of the head tank.

Thus, in the compressor system according to the present invention, since various elements such as the compressor main unit, the oil filter, and the oil separator are installed together in the head tank, miniaturization of the system is facilitated. Furthermore, manufacturing costs decrease, and vibrations and loss of pressure are minimized by reducing the lengths of the compressed air line and the oil line.

BRIEF DESCRIPTION OF THE DRAWINGS

The above objectives and advantages of the present invention will become more apparent from the following description of a preferred embodiment considered with reference to the attached drawings in which.

DETAILED DESCRIPTION OF THE INVENTION

Figure 1:
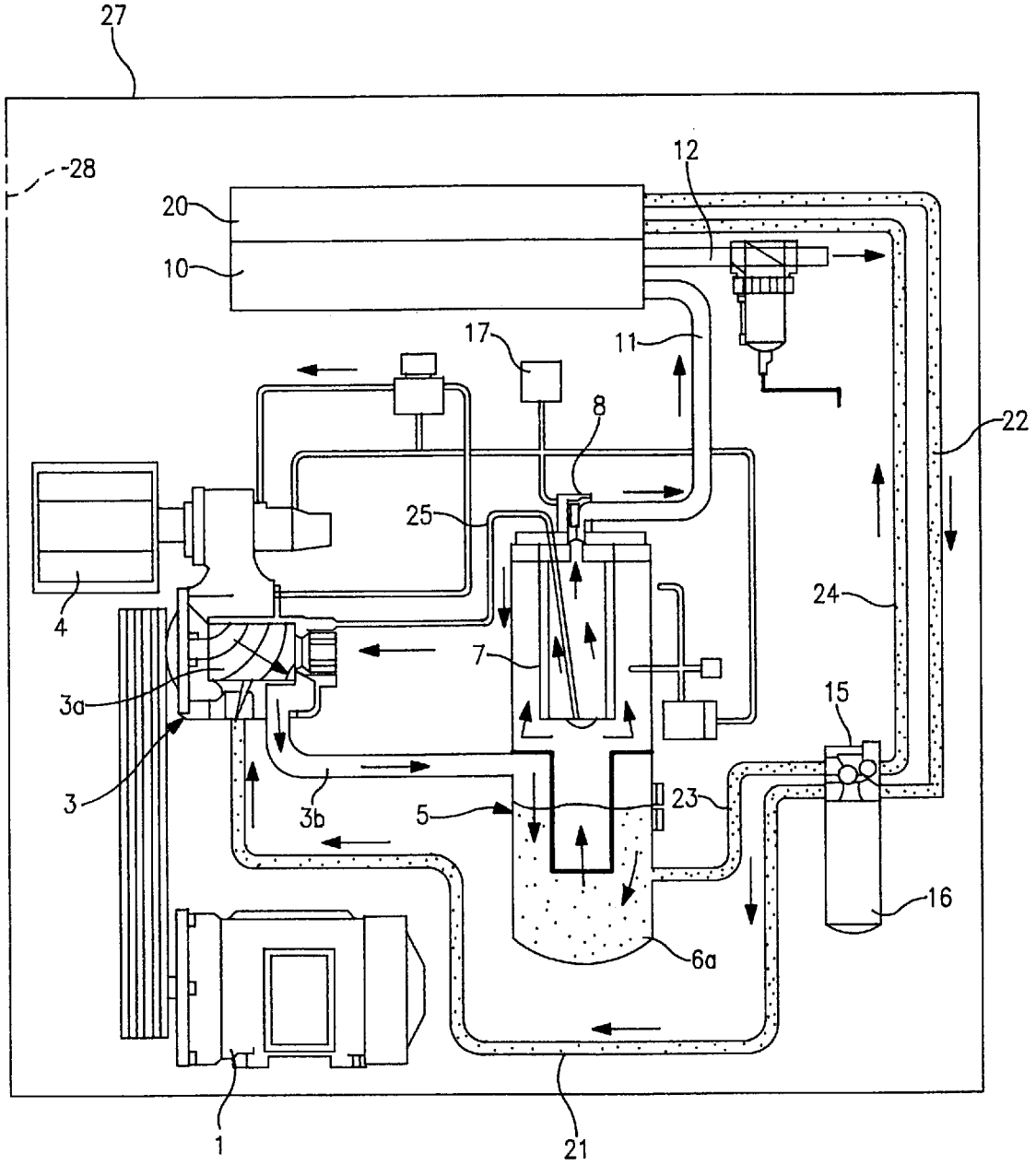
FIG. 1 PRIOR ART
FIG. 1 is a schematic view illustrating a conventional compressor system.
Figure 2:
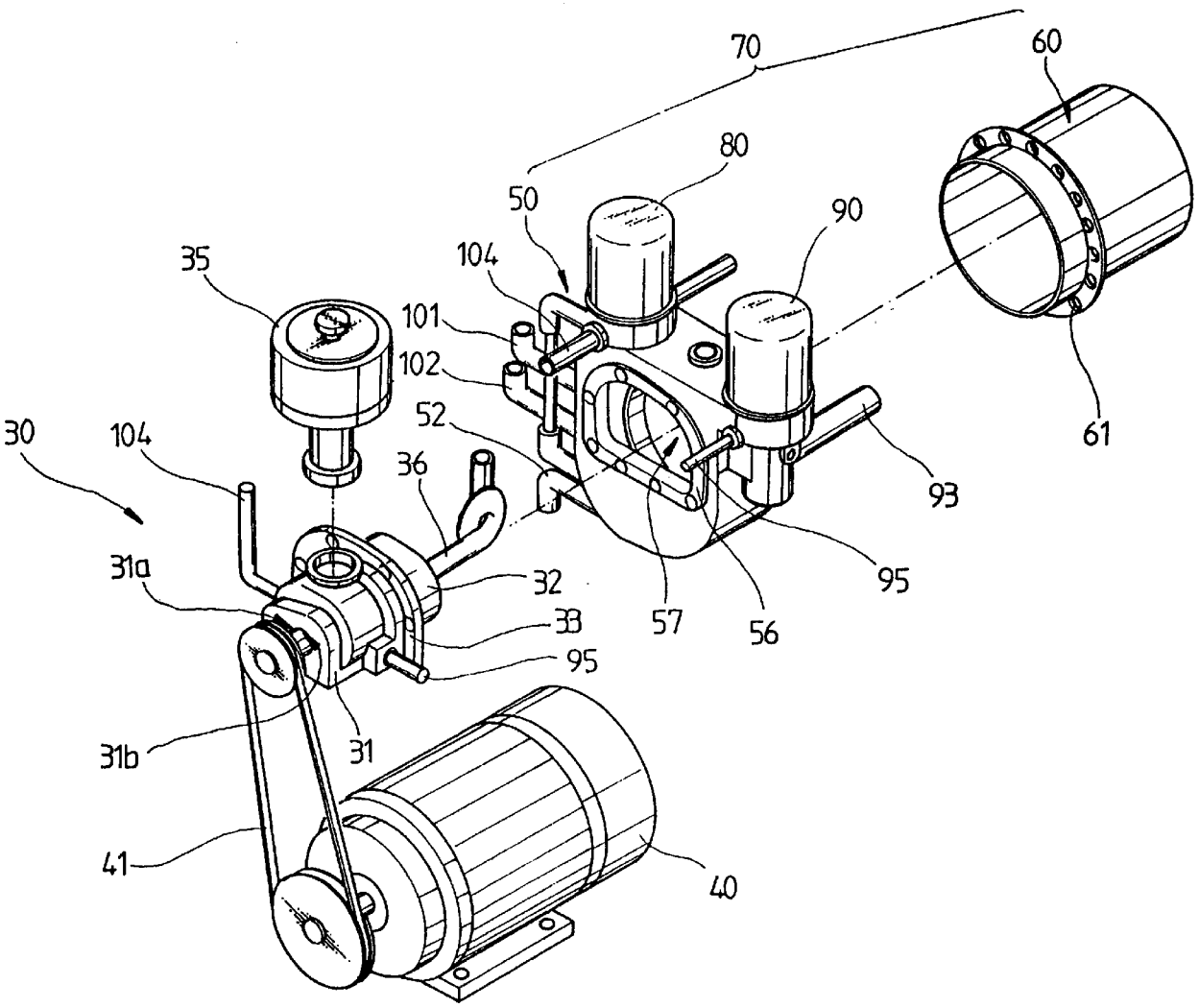
FIG. 2 is an exploded perspective view illustrating a compressor system according to an embodiment of the present invention.

In FIG. 2, reference numeral 30 indicates a compressor main unit which includes a rotor casing 31 and an exhaust casing 32 which is combined with the rotor casing 31.

In the rotor casing 31, a pair of female and male rotors (not shown) are installed on two parallel shafts 31*a* and 31*b* to rotate while being engaged with each other. Shafts axis 31*b* is driven while coupled to a driving motor 40 by a belt 41. An intake chamber (not shown) into which air is taken is formed in the rotor casing 31 and an exhaust chamber (not shown) from which air is exhausted is formed in the exhaust casing 32. Also, an air cleaner 35 which filters the air taken into the intake chamber is installed in the rotor casing 31.

An accumulator 70 coupled to the compressor main unit 30 includes a reservoir 60 for accommodating compressed air and oil exhausted from the exhaust chamber and a head tank 50 having an inner space and coupled to the reservoir 60 and the compressor main unit 30.

The reservoir 60 is formed of a metal plate by a pressing process, and a flange portion 61 having coupling holes spaced apart at predetermined intervals is formed at the edge of an inlet of the reservoir 60.

Figure 4:
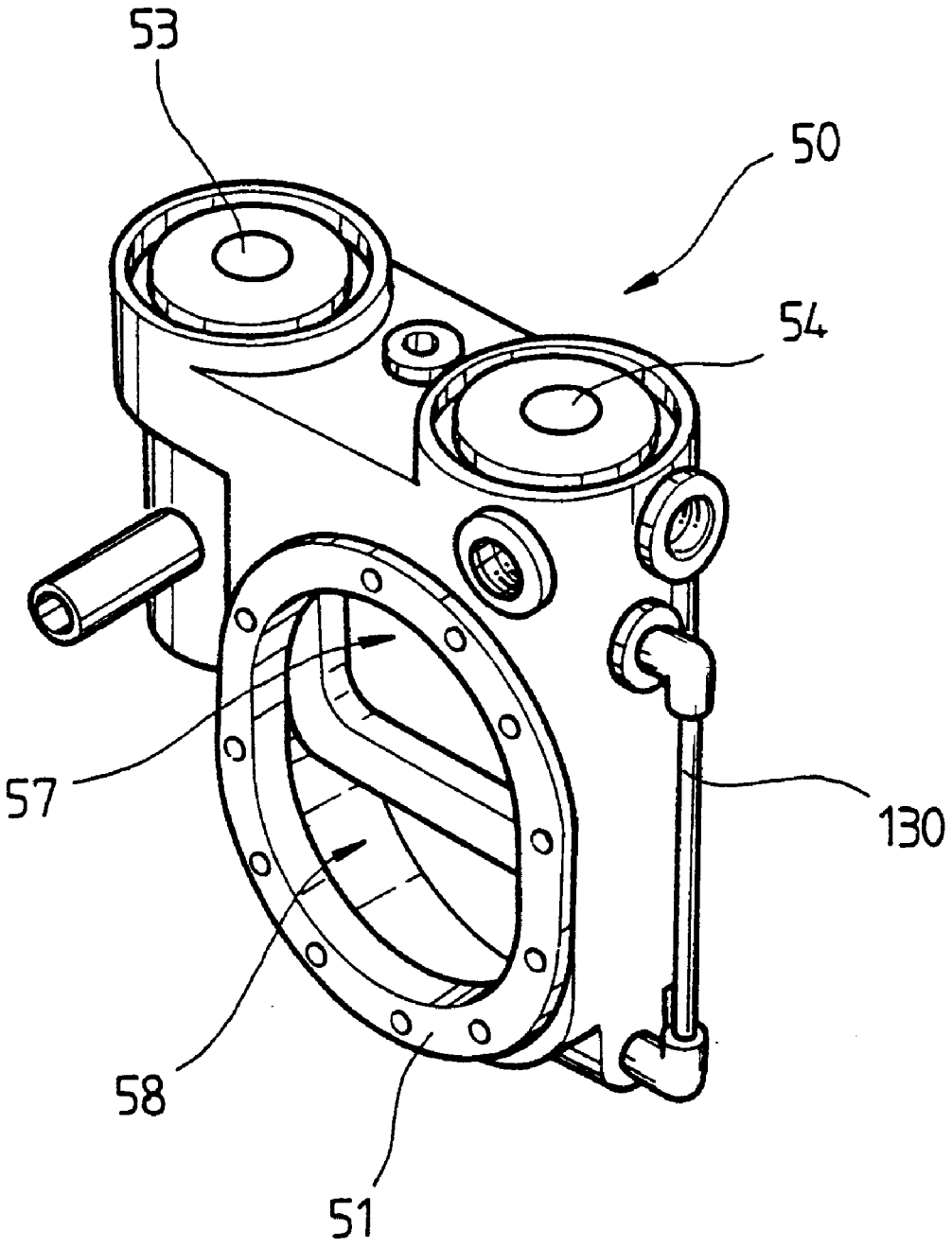
FIG. 4 is a perspective view illustrating the head tank shown in FIG. 2.
Figure 5:
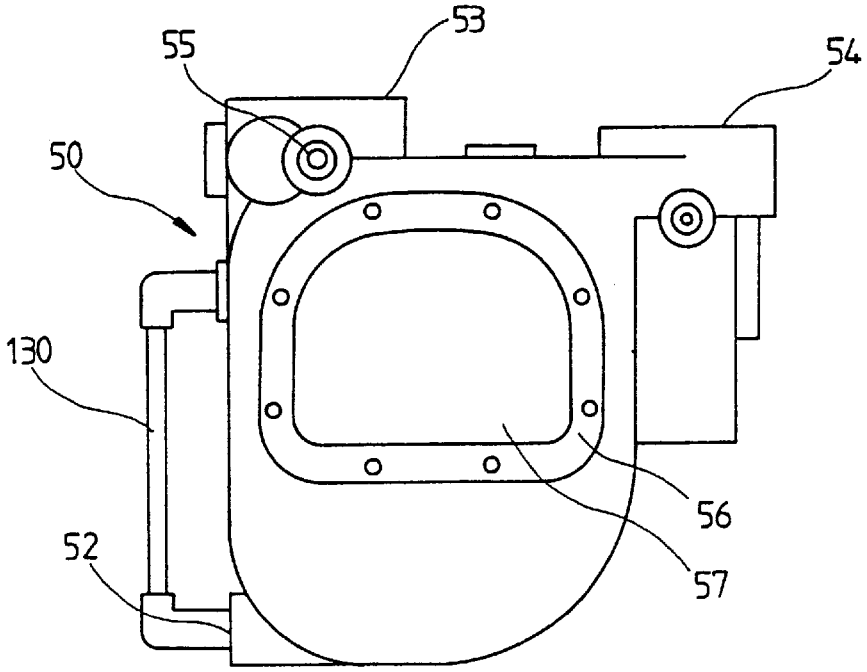
FIG. 5 is a front view of the head tank shown in FIG. 2.
Figure 6:
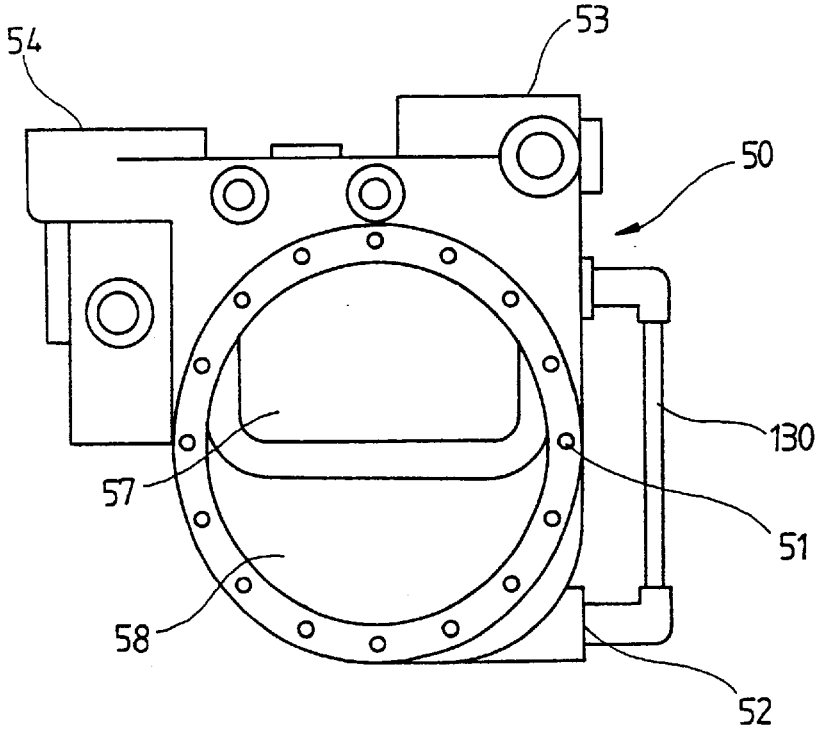
FIG. 6 is a rear view of the head tank shown in FIG. 2.

The structure of the head tank 50 is shown in detail in FIGS. 4 through 6. Referring to the drawings, a flange portion 51 which is coupled to the flange portion 61 of the reservoir 60 (see FIG. 2) by bolts is formed on one side surface of the head tank 50. Also, a first opening 57 coupled to the compressor main unit 30 is formed on one side of the head tank 50 and a second opening 58 coupled to the reservoir 60 is formed on the other side thereof.

Figure 7:
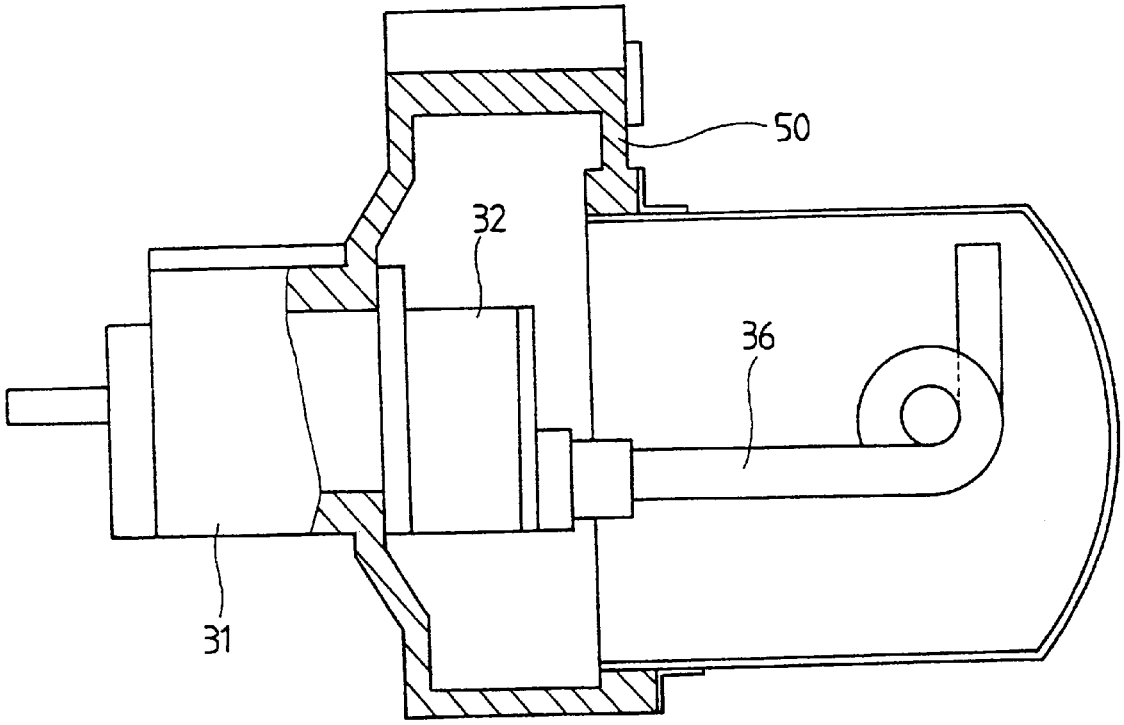
FIG. 7 is a sectional view illustrating an example in which a compressor main unit and the head tank are integrally combined according to the present invention.

A rotor flange 33 (see FIG. 2) is installed between the rotor casing 31 and the exhaust casing 32. The rotor flange 33 is coupled using bolts with a plate 56 formed around the first opening 57 of the head tank 50 so that the compressor main unit 30 is fixed to the head tank 50. Alternatively, without the plate 56, the rotor flange 33 can be directly coupled to the head tank 50 through screw holes (not shown) radially formed at predetermined intervals around the first opening 57. Also, the rotor casing 31 and the head tank 50 can be integrally formed by welding or molding, as shown in FIG. 7.

A drain 52 for expelling sediment in the reservoir 60 is formed at the bottom portion of the head tank 50. An oil gauge 130 which indicates the amount of oil in the reservoir 60 is installed at the flank surface of the head tank 50. The oil gauge 130 includes a translucent tube connected to the head tank 50 at the upper and lower portions thereof to communicate with the inside of the head tank 50.

Figure 3:
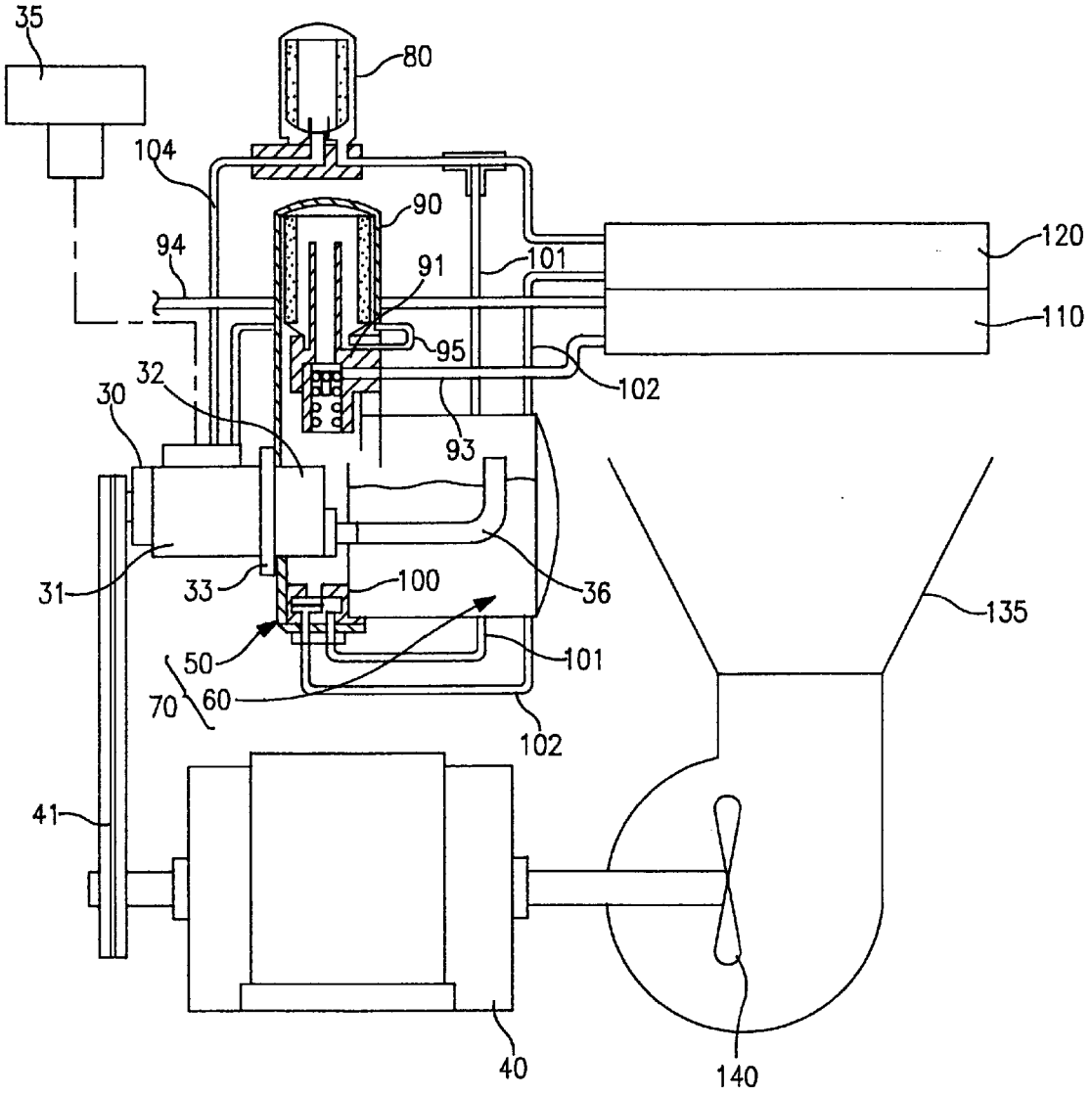
FIG. 3 is a schematic diagram showing the structural arrangement of elements of the compressor system according to the embodiment of the present invention.

In FIG. 3, the structural elements of the compressor system are shown with emphasis on the function and arrangement of the elements with respect to the path of air and oil. For instance, it can be seen from FIG. 2 that the oil filter 80 is actually coupled to the head tank 50.

As shown in the drawing, the compressor system according to the present invention includes an air cooler 110 and an oil cooler 120 for respectively cooling compressed air and oil which are exhausted from the accumulator 70. On the head tank 50, an oil separator 90, the oil filter 80 and a regulator 100 are installed. The oil separator 90 is for separating the oil included in the compressed air in the reservoir 60. The oil filter 80 is for filtering the oil exhausted from the reservoir 60 and the oil passing through the oil cooler 120. The regulator 100 is for controlling the selective transfer of the oil exhausted from the reservoir 60 to the oil filter 80 or the oil cooler 120 according to the temperature of the oil. The oil filter 80, oil separator 90 and regulator 100 are installed at coupling portions 53, 54 and 55, respectively, (see FIGS. 4 and 5) of the head tank 50.

Also, a pressure valve 91 is installed in the oil separator 90 which opens when the compressed air in the reservoir 60 is beyond a preset pressure.

A cooling unit which cools the air cooler 110 and the oil cooler 120 is comprised of a fan 140 rotated by the driving motor 40 and a duct 135 which guides the flow of air generated by the fan 140.

An exhaust pipe 36 for guiding the exhausted compressed air and oil is coupled to the exhaust casing 32 and the outlet end portion of the exhaust pipe 36 is bent upward. Further, as shown in FIG. 2 and FIG. 7, the outlet portion of the exhaust pipe may have a spiral shape like a pig's tail. The compressed air discharged from the exhaust pipe 36 is supplied to the oil separator 90 installed in the head tank 50 through the reservoir 60. Thus, the oil included in the compressed air can be effectively separated.

The operation of the compressor system according to an embodiment of the present invention structured as above will now be described with reference to FIGS. 2 and 3.

When the female and male rotors (not shown) installed on the two axes 31a and 31b in the rotor casing 31 are rotated by the driving motor 40, the air taken in through the air filter 35 is compressed and exhausted to the reservoir 60. Also, the fan 140 is rotated by the driving motor 40 to cool the air cooler 110 and the oil cooler 120.

In the rotor casing 31, oil is supplied through the main oil supply pipe 104 and the auxiliary oil supply pipe 95 to prevent abrasion and heating due to the rotation of the rotors. Thus, the oil splashes when the air compressed by the rotation of the rotors is exhausted through the exhaust pipe 36 and a portion of the splashed oil precipitates inside the reservoir 60. Here, the compressor main unit 30 is directly coupled to the head tank 50 without additional piping so that loss of pressure of the compressed air due to friction while passing through the additional piping is minimized.

The compressed air and the splashed oil in the reservoir 60 pass through the oil separator 90. At this time, oil is supplied to the rotor casing 31 through the auxiliary oil supply pipe 95 after being filtered, and the compressed air is transferred to the air cooler 110 through an air pipe 93 to be cooled and then is exhausted through a service pipe 94.

During the initial operation of the compressor, when the oil in the reservoir 60 is below the set temperature, the oil is transferred through a first oil supply pipe 101 by the operation of the temperature regulator 100. When the temperature of the oil is beyond the set temperature during operation of the compressor, the oil passes through the first oil supply pipe 102 and the oil cooler 120 to be transferred to the oil filter 80.

Figure 8:
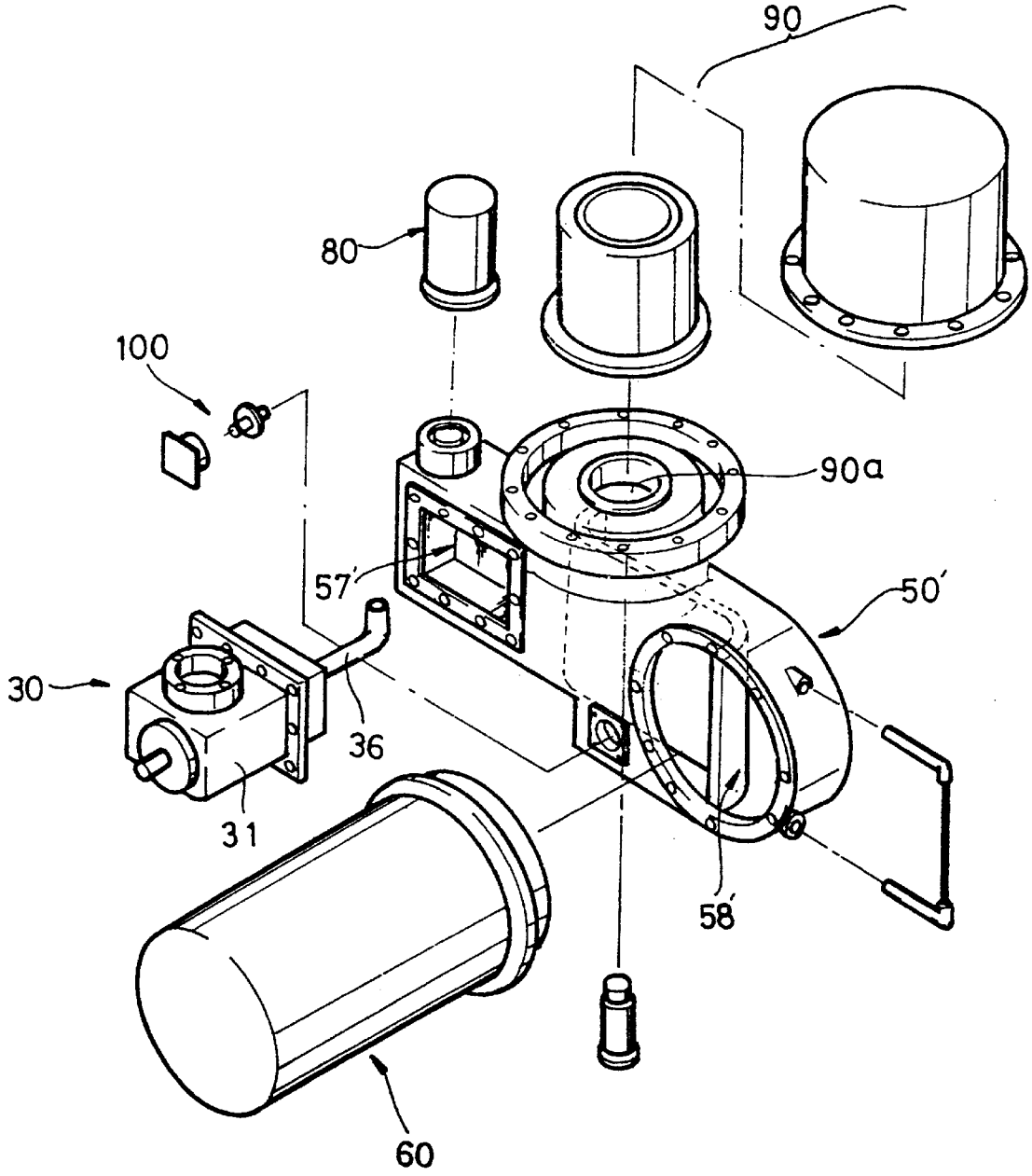
FIG. 8 is an exploded perspective view showing major elements of a compressor system according to another embodiment of the present invention.

In FIG. 8, major elements of a compressor system according to another embodiment of the present invention is schematically illustrated. Here, the same reference numerals represent the same elements in this drawing and the previous drawings. According to a characteristic feature of this embodiment of the present invention, a first opening 57' and a second opening 58' to which the compressor main unit 30 and the reservoir 60 are coupled respectively are formed together at one side of a head tank 50'. That is, since both the compressor main unit 30 and the reservoir 60 are coupled to the head tank 50' at one side thereof, the compressor system can be made compact.

The coupling of the compressor main unit 30 and the head tank 50' and the reservoir 60 and the head tank 50' are performed by the same method as described in the previous embodiment. However, due to a limitation in the work space to couple the exhaust pipe 36 to the exhaust casing 32, the rotor casing 31 and the head tank 50' cannot be fabricated in one body.

Figure 9:
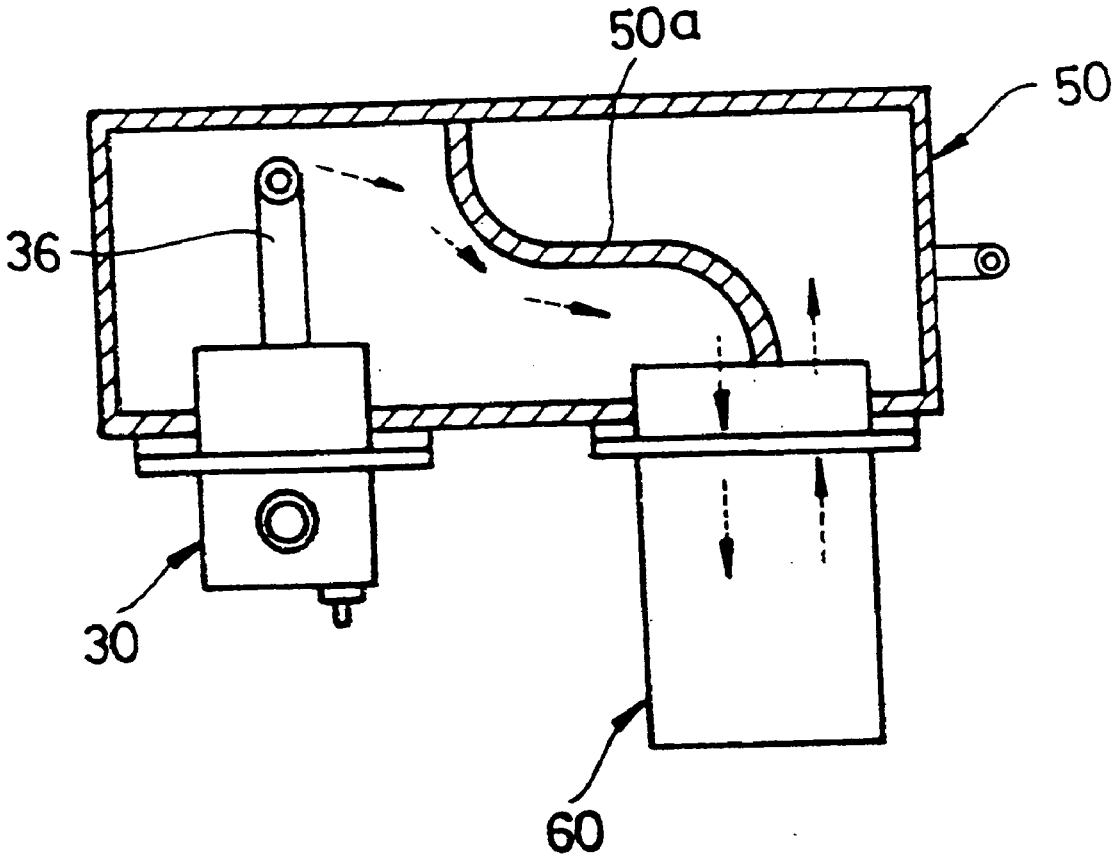
FIG. 9 is a partial cross sectional view showing the head tank, the compressor main unit and the reservoir shown in FIG. 8.

As shown in FIG. 9, a partitioning member 50*a* is preferably installed inside the head tank 50' to separate the exhaust pipe 36 and an entrance 90*a* of the oil separator 90 (see FIG. 8). In this case, the compressed air and the splashed oil exhausted from the exhaust pipe 36 arrive at the oil separator 90 after passing through the reservoir 60 as indicated by the arrow in the drawing. Here, a portion of the splashed oil precipitates in the reservoir 60 and the remaining oil sticks to the oil separator 90.

The compressor system according to the preferred embodiment of the present invention as described above has the following advantages.

First, since the compressor main body, the oil filter, the oil separator, the temperature regulator are all installed in the head tank, loss in the pipe can be reduced, leakage of compressed air and oil due to vibrations and impact can be prevented, and simultaneously the system itself can be miniaturized.

Second, since the reservoir is formed of a metal plate by a pressing process, productivity can be improved.

Third, since a portion of the splashed oil from the exhaust pipe precipitates and is stored in the reservoir and only the remaining oil reaches the oil separator, the efficiency of oil separation of the oil separator can be increased and the life span thereof can be extended.

It is noted that the present invention is not limited to the preferred embodiment described above, and it is apparent that variations and modifications by those skilled in the art can be effected within the spirit and scope of the present invention defined in the appended claims. For instance, another sort of gas, instead of air, can be used for the above compressor.

What is claimed is:

1. A compressor system comprising:

a compressor main unit for compressing air which is taken in and exhausting the compressed air with oil;

a head tank having an internal space and being coupled to said compressor main unit so that the internal space of said head tank is opened to said compressor main unit;

a reservoir in which compressed air and oil exhausted from said compressor main unit are stored and being separately formed from said head tank and mounted on an exterior of said head tank; and an oil separator mounted on the exterior of said head tank and fluidly communicating with an interior of said head tank for separating the oil exhausted from said compressor main unit from the compressed air.

2. A compressor system as claimed in claim 1, further comprising an oil filter for filtering oil contained in the compressed air in said reservoir and fluidly communicating with an interior of said head tank, and a regulator fluidly communicating with an interior of said head tank and controlling flow of oil from said head tank to said oil filter and to an oil cooler according to a temperature of the oil.

3. A compressor system as claimed in claim 1, wherein said reservoir is bolted to the exterior of said head tank.

4. A compressor system as claimed in claim 1, wherein said oil separator is mounted on a top surface of said head tank.

5. A compressor system as claimed in claim 1, wherein said compressor is mounted on said head tank above a lower end of said head tank.

6. A compressor system as claimed in claim 1, wherein a first opening to which said compressor main unit is coupled is formed on one side of said head tank and a second opening to which said reservoir is coupled is formed on an opposite side of said head tank.

7. A compressor system as claimed in claim 6, further comprising an exhaust pipe connected to said compressor main unit and extending through said head tank to inside said reservoir, for guiding the compressed air and the oil exhausted from said compressor main unit.

8. A compressor system as claimed in claim 7, wherein an end portion of an outlet portion of said exhaust pipe is bent upward.

9. A compressor system as claimed in claim 7, wherein an outlet portion of said exhaust pipe has a spiral shape and an end portion of said outlet portion is bent upward.

10. A compressor system as claimed in claim 7, wherein said reservoir comprises a metal plate shaped by a pressing process.

11. A compressor system as claimed in claim 7, wherein said exhaust pipe is spaced from the interior of said head tank and said reservoir.

12. A compressor system as claimed in claim 7, wherein said compressor main unit comprises:

a rotor casing having an intake chamber into which air is taken;

an exhaust casing coupled to said rotor casing and having an exhaust chamber into which the compressed air flows from said rotor casing, wherein said exhaust pipe is installed on said exhaust casing.

13. A compressor system as claimed in claim 12, wherein an end portion of an outlet portion of said exhaust pipe is bent upward.

14. A compressor system as claimed in claim 12, wherein an outlet portion of said exhaust pipe has a spiral shape and an end portion of said outlet portion is bent upward.

15. A compressor system as claimed in claim 12, wherein said compressor main unit further comprises a rotor flange which is installed between said rotor casing and said exhaust casing and which is coupled to a flange formed around said first opening of said head tank.

16. A compressor system as claimed in claim 12, wherein said exhaust casing extends into said head tank and said rotor casing is disposed outside said head tank.

17. A compressor system as claimed in claim 1, wherein said compressor main unit comprises:

a rotor casing having an intake chamber into which air is taken; and an exhaust casing coupled to said rotor casing and having an exhaust chamber into which the compressed air flows from said rotor casing, wherein said rotor casing is integrally formed with said head tank.

18. A compressor system as claimed in claim 17, wherein said rotor casing and said head tank are integrally formed by metal casting.

19. A compressor system as claimed in claim 1, wherein a first opening coupled to said compressor main unit and a second opening coupled to said reservoir are separately formed on a same side of said head tank.

20. A compressor system as claimed in claim 19, wherein said compressor main unit comprises:

a rotor casing having an intake chamber into which air is taken;

an exhaust casing coupled to said rotor casing and having an exhaust chamber into which the compressed air flows from said rotor casing; and a rotor flange installed between said rotor casing and said exhaust casing and coupled to a flange which is formed around said first opening of said head tank.

21. A compressor system as claimed in claim 20, further comprising an exhaust pipe installed on said exhaust casing for guiding the compressed air and oil being exhausted toward said reservoir.

22. A compressor system as claimed in claim 21, wherein an portion of the outlet of said exhaust pipe is bent upward.

23. A compressor system as claimed in claim 21, wherein an outlet portion of said exhaust pipe has a spiral shape and an end portion of said outlet portion is bent upward.

* * * * *